US012187395B1

(12) United States Patent
Lin et al.

(10) Patent No.: US 12,187,395 B1
(45) Date of Patent: Jan. 7, 2025

(54) FLEXIBLE DYNAMIC CAPTURING SYSTEM FOR UNDERWATER MOVING CARRIER

(71) Applicant: ZHEJIANG UNIVERSITY, Hangzhou (CN)

(72) Inventors: Mingwei Lin, Hangzhou (CN); Ri Lin, Hangzhou (CN); Canjun Yang, Hangzhou (CN); Anzhe Yi, Hangzhou (CN); Zilin Xing, Hangzhou (CN); Bohao He, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 18/641,414

(22) Filed: Apr. 21, 2024

(30) Foreign Application Priority Data

Jun. 25, 2023 (CN) ..... 202310758184.7

(51) Int. Cl.
*B63B 27/16* (2006.01)
*B63C 7/20* (2006.01)
*B63C 11/52* (2006.01)

(52) U.S. Cl.
CPC ..... *B63C 7/20* (2013.01); *B63C 11/52* (2013.01); *B63B 2027/165* (2013.01)

(58) Field of Classification Search
CPC ..... B63C 7/20; B63C 11/52; B63G 2008/008; B63B 2027/165; B63B 27/36
See application file for complete search history.

(56) References Cited

U.S. PATENT DOCUMENTS 3,109,404 A * 11/1963 Hartel ..... B63B 59/02 114/219
2016/0009344 A1* 1/2016 Jourdan ..... B63G 8/18 114/321
2022/0161913 A1* 5/2022 Cadalen ..... B63C 7/20

FOREIGN PATENT DOCUMENTS

CN 210000531 U 1/2020
CN 113901593 A 1/2022
CN 114161470 A * 3/2022
CN 114228956 A 3/2022
CN 115310215 A 11/2022

* cited by examiner

*Primary Examiner* — Andrew Polay
(74) *Attorney, Agent, or Firm* — Jiwen Chen; Joywin IP Law PLLC

(57) ABSTRACT

The present invention discloses a flexible dynamic capturing system for an underwater moving carrier, including a shell, a front-end flexible guide apparatus, at least one tail flexible hand clamping and fastening apparatus, and a bottom retracting apparatus fastened in the shell. The front-end flexible guiding apparatus includes several flexible arms, the several flexible arms are fastened on a first rigid base in a circumferential array. The flexible arms can bend to an inner side and outer side of a circumference respectively when driven. Each tail flexible hand clamping and fastening apparatus includes several flexible claws, and the several flexible claws are divided into two groups and fastened on a second rigid base. When the flexible claws are driven, the two groups of flexible claws can bend and wind relative to each other. The bottom retracting apparatus implements lifting or lowering of the front-end flexible guide apparatus and the tail flexible hand clamping and fastening apparatus. The flexible dynamic capturing system for the present invention can capture underwater moving carriers of different diameters, and can be retracted and stored with a compact volume.

4 Claims, 3 Drawing Sheets

FLEXIBLE DYNAMIC CAPTURING SYSTEM FOR UNDERWATER MOVING CARRIER

This application claims priority of Chinese Application No. 2023107581847, Jun. 25, 2023, which is hereby incorporated by reference.

TECHNICAL FIELD

The present invention relates to the field of underwater vehicle recovery technologies, and in particular to a flexible dynamic capturing system for an underwater moving carrier.

BACKGROUND TECHNOLOGY

An autonomous underwater vehicle is a highly maneuverable underwater moving carrier that can carry out detection missions by carrying various devices. Because the underwater moving carrier is usually powered by batteries, the underwater moving carrier needs to be recovered and recharged regularly. At present, an underwater recovery apparatus usually uses a horn-shaped rigid docking station, and is usually used for deployment and recovery of moving carriers with small-diameter (such as diameter of 180, 324, and 533). If such mechanism is directly extended to deployment and recovery of a large carrier, the mechanism will be very large to be installed, greatly reducing space utilization of an underwater mother vehicle.

In addition to a cone-shaped guidance and recovery mechanism, some researchers have currently proposed a concept of recovering the underwater moving carrier through a rigid mechanical manipulatorwith a large extension ratio. Although this recovery system can be folded, rigid collision can easily cause damage to the underwater moving carrier, and a driving system of the rigid mechanical manipulator generates great noise. The Chinese patent No. ZL202111496014.3 discloses an underwater flexible arm and an underwater flexible recovery mechanism. The underwater flexible arm includes a composite unit, a torsion unit, a two-way pump, a three-position three-way valve, a motor, and a control unit. The composite unit and the torsion unit are firmly connected and made of a flexible material. The torsion unit includes a spiral chamber with one open port. The composite unit includes at least five cylindrical chambers, each with one open port. Open ports of the spiral chambers and open ports of the cylindrical chambers are provided with two-way pumps and three-position three-way valves. The two-way pumps are driven by a motor. The control unit controls the motor and the three-position three-way valves, to implement a same shape but a changeable stiffness function of the underwater flexible arm. The underwater flexible recovery mechanism of an AUV includes a bottom plate and a long arm unit. Each long arm unit includes at least two underwater flexible arms that are formed with a head and a tail connected in series. The patent can perform decoupling control on a shape and stiffness of the flexible arm, but cannot adapt to a recovery task of the underwater moving carriers of different sizes.

In a rendezvous and docking scene of mother and son underwater vehicles, the carrier recovery apparatus needs to keep a specific safe distance from the mother vehicle, to prevent collision damage caused by inaccurate control of vehicles. However, at present, neither a rigid recovery apparatus nor a flexible recovery apparatus can achieve action with a large extension ratio, which means that the mechanical arm needs to occupy large space inside the mother vehicle when the mechanical manipulator is recovered and placed in the inner cabin, further restricting a cooperative operation capability of the underwater mother vehicle and the carrier.

Based on the above background analysis, it can be learned that a capturing apparatus that can flexibly capture the underwater moving carrier, adapt to a variety of carriers, and has characteristics of small volume, flexible scaling, and is placed at small space is to be developed urgently.

SUMMARY OF THE INVENTION

The present invention provides a flexible dynamic capturing system for an underwater moving carrier that can capture underwater moving carriers of different diameters, and can be retracted and stored with a compact volume.

The technical solutions of the present invention are as follows.

A flexible dynamic capturing system for an underwater moving carrier, including a shell, a front-end flexible guide apparatus, at least one tail flexible hand clamping and fastening apparatus, and a bottom retracting apparatus fastened in the shell, where

- the front-end flexible guide apparatus includes several flexible arms and a first rigid base; the several flexible arms are fastened on the first rigid base in a circumferential array, and the flexible arms are capable of bending to an inner side and outer side of a circumference respectively when driven;
- each tail flexible hand clamping and fastening apparatus includes several flexible claws and a second rigid base; the several flexible claws are divided into two groups and fastened on the second rigid base; when the flexible claws are driven, the two groups of flexible claws are capable of bending and winding relative to each other;
- the bottom retracting apparatus includes a winch fastened in the shell and a first vertical flexible arm and a second vertical flexible arm that are connected to the winch; the first rigid base is connected to the first vertical flexible arm through a bending rod, and the second rigid base is connected to the second vertical flexible arm through a bending rod; the front-end flexible guide apparatus and the tail flexible hand clamping and fastening apparatus are lifted or lowered by retracting the first vertical flexible arm and the second vertical flexible arm through the winch; and the first vertical flexible arm and the second vertical flexible arm are provided with liquid-filled flow channels.
- the flexible arm, the first vertical flexible arm, and the second vertical flexible arm are made of a soft material, outer surfaces thereof are covered with constraint layers that limit radial expansion of the flexible arms; and the liquid-filled flow channels are provided inside the flexible arms.
- two symmetrically distributed liquid-filled flow channels are provided inside the flexible arm along an axial direction. During driving, liquid is filled into the two liquid-filled flow channels, and a bending direction of the flexible arm is controlled by controlling a pressure difference between fluid in the two liquid-filled flow channels.

Preferably, an electronic compass for attitude feedback is installed at an end of the flexible arm. A cable routing hole is provided inside the flexible arm for placing a watertight cable.

Preferably, the soft material is silicone rubber; and the constraining layer is a fiber-rope braided layer.

Preferably, a blocking net is installed on an inner side of the flexible arm of the front-end flexible guide apparatus. The blocking net is configured to stress a plurality of flexible arms simultaneously when the underwater moving carrier collides with the front-end flexible guide apparatus, reducing an ultimate collision force.

Preferably, each front-end flexible guide apparatus includes 6 to 8 flexible arms.

Preferably, the flexible claw includes a root section, a middle section, and an end section that are connected in sequence; and the root section is fastened on the second rigid base, when driven, root sections of the two sets of flexible claws bend toward the outside, and the middle sections and the end sections bend toward the inside. During driving, the two groups of flexible claws can wind carriers of different sizes at different unfolding angles with small space occupied during winding and storage.

the flexible claw is a flexible tube provided with the liquid-filled flow channel inside, a tube wall on one side is corrugated, a tube wall on the other side is flat, and a flat tube wall is provided with a strain limiting layer. After fluid is introduced into the liquid-filled flow channel, a corrugated tube wall on one side is deformed and expanded under a fluid pressure, and an elastic modulus of the strain limiting layer is great, so that the flexible claw is bent toward a plane side and winds the underwater moving carrier.

Preferably, each tail flexible hand clamping and fastening apparatus includes 2 to 6 flexible claws.

During operation, driving of the flexible arm and the flexible claw is divided into a liquid pre-filling stage and a rapid actuation stage; during the liquid pre-filling stage, a liquid volume in the liquid-filled flow channel is kept the same as a volume of the liquid-filled flow channel without squeezing the liquid-filled flow channel; and during the rapid actuation stage, an internal pressure of the flexible arm or the flexible claw is increased by adding fluid to the liquid-filled flow channel, thereby causing the flexible arm or flexible claw to bend rapidly.

In the liquid pre-filling stage, liquid is slowly pumped into the liquid-filled flow channel inside the flexible arm or flexible claw through a small-flow pump until a liquid volume is the same as a volume of an internal cavity without squeezing the liquid-filled flow channel; and when the underwater moving carrier enters capturing space of the flexible arm, small-flow liquid supplementing is performed, which rapidly increases a cavity pressure of the flexible arm or the flexible claw, and an equivalent moment is generated on the flexible arm or the flexible claw to enable the flexible arm or the flexible claw to be quickly bent, implementing rapid actuation of the flexible arm and the flexible claw with a small flow.

Preferably, net buoyancy forces in the water of the first vertical flexible arm and the second vertical flexible arm are positive values. When the winch rotates forward, rigidity of the vertical flexible arm is increased rapidly after being detached from the winch; and when the winch rotates reversely, liquid inside the vertical flexible arm is discharged to relieve pressure.

A part that is of the vertical flexible arm and that is detached from the winch quickly pumps seawater into the vertical flexible arm through a hydraulic pump. An internal liquid-filled flow channel inside the flexible arm is squeezed and expanded by the liquid, and outside of the vertical flexible arm is wrapped and constrained by a fiber rope, increasing the rigidity of the flexible arm. After the flexible arm is released from the winch, the flexible arm rises upward under the action of a positive buoyancy to form a vertical flexible arm, while a part of the flexible arm filled with liquid remains on the winch, so that rigidity of a rigid-flexible junction at a root of the vertical flexible arm is enough to support a carrier recovery action on an upper part the flexible arm.

When the underwater moving carrier is captured, the front-end flexible guide apparatus, the tail flexible hand clamping and fastening apparatus, and the bottom retracting apparatus need to work together. When the underwater moving carrier has a large size, the front-end flexible guide apparatus limits an orientation of the underwater moving carrier and is then quickly closed. The flexible arms form a circumferential array to wrap the underwater moving carrier, the flexible claws trigger grasping and winds and fastens the underwater moving carrier, to prevent capturing failure due to upward tilting of a tail of the underwater moving carrier under the action of a positive buoyancy. When the underwater moving carrier has a small size, the flexible arms need to bend toward an inner side of a circumferential array of the flexible arms to compress the underwater moving carrier. In this case, the size of the flexible arm is enough to cover most of a length of the underwater moving carrier. Therefore, the flexible claws remain a winding state to wait to descend into a cabin. When the flexible arms and the flexible claws clamp and wrap the underwater moving carrier, the winch reverses and rolls up the vertical flexible arms, to drive the underwater moving carrier down into the shell, reducing the impact of water resistance on clamping stability of the underwater moving carrier. By far, recovery of the underwater moving carrier is completed.

Preferably, the flexible dynamic capturing system for an underwater moving carrier includes a sensing unit and a control unit;

the sensing unit is configured to sense a position of the underwater moving carrier and send a signal that triggers the front-end flexible guide apparatus, the tail flexible hand clamping and fastening apparatus, and the bottom retracting apparatus to act; and the control unit controls, according to the signals, the flexible guide apparatus, the tail flexible hand clamping and fastening apparatus, and the bottom retracting apparatus to act, to capture the underwater moving carrier.

The sensing unit is a sonar or a visual hybrid sensing apparatus.

The control unit uses a two-layer adaptive robust control method; and a control process is as follows: when the underwater moving carrier approaches the flexible dynamic capturing system, the sensing unit sends an action trigger signal, calculates desired postures of the flexible arm and flexible claw, and inputs the desired postures to the control unit; and the control unit first uses a back-stepping controller to design a control rate that satisfies Lyapunov stability, and forms desired speeds of the flexible arm and the flexible claw by using superposition of parameter adaptive regression of a posture and speed in a flexible arm model, model error compensation, nonlinear robust feedback, and linear stable feedback, and then based on current speeds of the flexible arm and flexible claw, parameter adaptive regression of a relationship between a speed and pressure of the flexible arm model, model error compensation, nonlinear robust feedback, and linear stable feedback is implemented again, to obtain control pressures of the flexible arm and flexible claw, implementing precise control of postures of the flexible arm and the flexible claw.

The flexible dynamic capturing system for the underwater moving carrier of the present invention is connected to a water surface mother ship through a towing cable.

Compared with the prior art, the present invention has the following beneficial effects.

(1) According to the present invention, vertical lifting or lowering of the underwater moving carrier is implemented and space utilization of a carrier recovery mother platform is improved by using rigidity adjustment of the underwater flexible arm and winch winding method. The flexible arm and flexible claw are rapidly driven with a small flow in the liquid pre-filling method, effectively reducing a hydraulic driving power and device volume of the carrier recovery system. Compared with a rigid mechanical arm or hydraulic lifting platform method, external radiation noise of the system is greatly reduced, and underwater concealment is improved.

(2) According to the present invention, through a combined action of the front-end flexible guide apparatus and the tail flexible hand clamping and fastening apparatus, underwater moving carriers of different geometric sizes can be flexibly captured, resolving a problem that a traditional underwater carrier recovery apparatus applies to only one type of objects.

(3) According to the present invention, the double-layer adaptive robust control method is used to compensate for control accuracy when the flexible arm model and parameters of the flexible arm model are inaccurate, and through adjustment of the intermediate speed target, coordinated control of a posture and speed of the flexible arm is implemented. Compared with the conventional control method, the method in the present invention improves control accuracy and an action response speed of the flexible arms.

DETAILED DESCRIPTION OF EMBODIMENTS

Figure 1A:
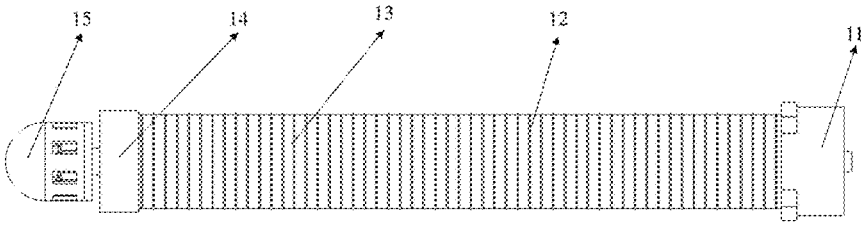
FIG. 1 (*a*) and FIG. 1 (*b*) are a schematic structural diagram of a flexible arm of a front-end flexible guide apparatus, where FIG. 1 (*a*) is a schematic structural diagram of a flexible arm, and FIG. 1 (*b*) is a schematic cross-sectional structural diagram of the flexible arm.

The present invention is further described in detail below with reference to the accompanying drawings and embodiments. It should be noted that the following embodiments are intended to facilitate the understanding of the present invention and do not limit the present invention in any way.

A flexible capturing system for an underwater moving carrier includes a front-end flexible guide apparatus, a tail flexible hand clamping and fastening apparatus, a bottom lifting or lowering retracting apparatus, and a system towing apparatus.

The front-end flexible guide apparatus includes flexible arms 1 wound with reinforcing fiber that form a circumferential array. A quantity of flexible arms of the flexible guide apparatus is preferably 6 to 8. The flexible arms 1 are installed on a rigid installing base plate 18, and a base is connected to a vertical flexible arm 32 through a bending rod 4.

Figure 1B:
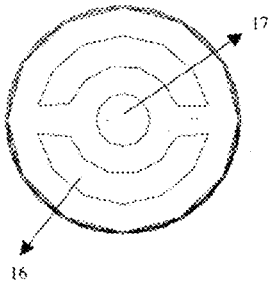

As shown in (a) of FIG. 1, a flexible arm body 13 made of a silicone rubber soft body is used to recover the underwater moving carrier. Outside of the flexible arm body 13 is wrapped by the reinforcing fiber 12 to constrain radial expansion, and an electronic compass 15 is installed at an end to perform attitude feedback control. A fastening joint 11 is installed at a root of the flexible arm body 13 for installing the flexible arm 1 on the installing base plate 18.

As shown in (b) of FIG. 1, there are two symmetrical liquid-filled flow channels 16 inside the flexible arm, and environmental liquid is pumped through a pump for pressurization. A cable routing hole 17 is provided in the middle of the flexible arm for placing a watertight cable corresponding to the electronic compass.

A plurality of flexible arms are evenly arranged on the installing base plate 18, so that a horn-shaped flexible guiding apparatus can be formed to restrain and guide the underwater moving carrier.

A blocking net is preferably installed on an inner side of the flexible arm, so that when the underwater moving carrier collides with the flexible guiding apparatus, a plurality of arms are stressed simultaneously, reducing an ultimate collision force to each arm.

The tail flexible hand clamping and fastening apparatus includes flexible claws 2. The flexible claws 2 are in a semi-bellow shape. A quantity of semi-bellow flexible arms 21 included in each group of flexible claws 2 is preferably four.

Figure 2A:
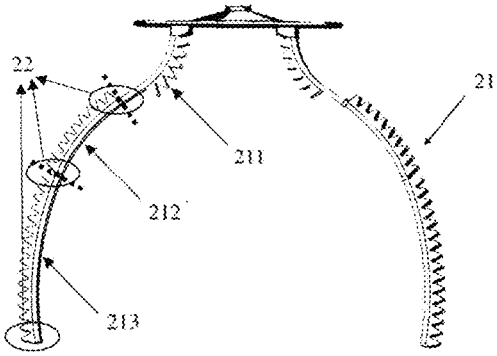
FIG. 2 (*a*) and FIG. 1 (*b*) are a schematic structural diagram of a rear-end flexible claw, where FIG. 2 (*a*) is an open state, and FIG. 2 (*b*) is a winding state.
Figure 2B:
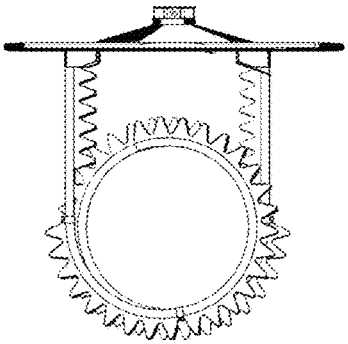

As shown in FIG. 2, one group of flexible claws 2 includes four semi-bellows flexible arms 21, and each semi-bellows flexible arm includes three small sections connected in series. After being filled with liquid, a root section 211 is bent toward the outside, and a middle section 212 and an end section 213 are bent toward the inside, so that carriers of different sizes can be winded at different unfolding angles, and space occupied during winding and storage can be kept small. Attitude sensors 22 are installed at joints and ends of the root section 211, the middle section 212, and the end section 213.

Figure 3:
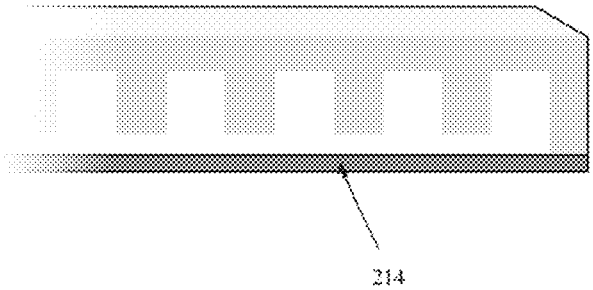
FIG. 3 (*a*) and FIG. 1 (*b*) are a schematic diagram of a driving principle of the rear-end flexible claw, where FIG. 3 (*a*) is a state without force, and FIG. 3 (*b*) is a state after fluid is introduced.
Figure 3:
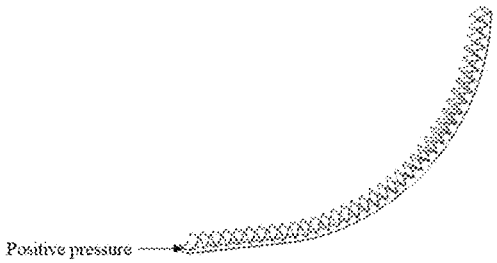

FIG. 3 is a schematic diagram of a driving principle for one section of the flexible claw. One side of a structure is bellows-shaped, and a plane of the other side is pasted with a strain limiting layer 214 with a larger elastic modulus, so that the flexible arm bends toward an opposite side of a bellows after fluid is introduced.

According to geometric sizes of different underwater moving carriers, the flexible guide apparatus and the flexible claw are clamped and winded in different manners. A preferred manner is as follows:

When the underwater moving carrier has a large size, the front-end flexible guide apparatus forms a shape that an inner diameter of a circumference distributed just wraps the carrier, and the flexible claw wraps around a middle part and rear part of the carrier, to prevent a tail of the carrier from tilting up under a positive buoyancy and leading to capturing failure. When the underwater moving carrier has a small size, the front-end flexible guide apparatus needs to bend to an inner side of a circumference distributed to compress the carrier, and the tail flexible claw remains bent and wrapped and is not in contact with the carrier.

Figure 4:
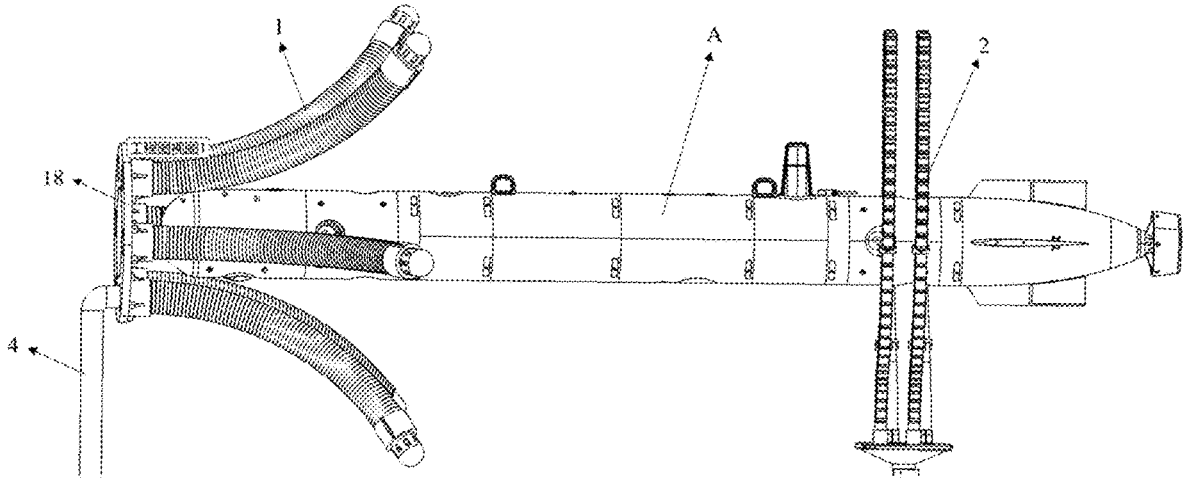
FIG. 4 is a schematic diagram describing that an underwater flexible arm and a flexible claw capture a carrier with a diameter of 324 mm.
Figure 5:
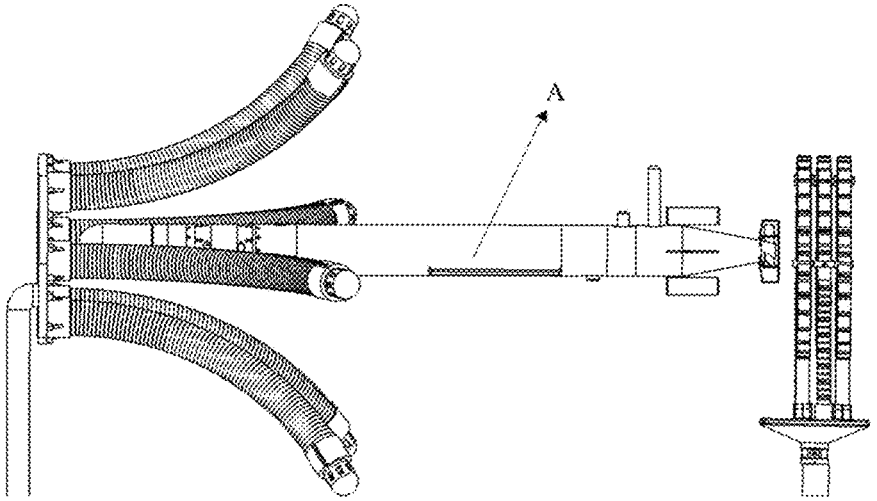
FIG. 5 is a schematic diagram describing that an underwater flexible arm and a flexible claw capture a carrier with a diameter of 180 mm.

FIG. 4 and FIG. 5 show a manner in which the front-end flexible guide apparatus and the rear-end flexible claw cooperate to grasp different underwater moving carriers. Optionally, when a diameter of an underwater moving carrier A is 324 mm, the flexible guide apparatus and the flexible claws 2 need to act cooperatively. To be specific, after the flexible guide apparatus limits a carrier direction, the flexible guide apparatus is quickly closed, and then the flexible claws 2 are triggered to grasp and wind and fasten the underwater moving carrier. When a diameter of the underwater moving carrier is 180 mm, a size of flexible arms 1 is enough to cover most of a length of the underwater moving carrier. Therefore, the flexible claws 2 remain in a winding state and wait for the carrier to drop into a cabin.

Driving manners for the front-end flexible guide apparatus and the rear-end flexible claws are divided into two stages: liquid pre-filling and rapid actuation. In a previous stage, liquid is slowly pumped into an internal cavity of the flexible arm through a small-flow pump until a liquid volume is the same as a volume of the internal cavity, without squeezing an internal flow channel. When the underwater moving carrier enters capturing space of the flexible arm, a characteristic of a liquid volume modulus is used to perform small-flow liquid supplementing, which rapidly increases a cavity pressure of the flexible arm and generates an equivalent moment on the flexible arm to make the flexible arm quickly bend, implementing rapid actuation of the flexible arm with a small flow.

A two-layer adaptive robust control method is used for the flexible arms. When the underwater moving carrier approaches the flexible capturing system, an underwater sonar/visual hybrid sensing system sends an action trigger signal, calculates a desired posture of the flexible arms, and inputs the desired posture into a control system. The control system first uses a back-stepping controller to design a control rate that satisfies Lyapunov stability, and forms an intermediate target control amount, that is, a desired speed of the flexible arm, by using superposition of parameter adaptive regression of a flexible arm model (a posture and velocity model), model error compensation, nonlinear robust feedback, and linear stable feedback. Furthermore, based on a current speed of the flexible arm, a control pressure of the underwater flexible arm is obtained through four calculation steps including parameter adaptive regression of a flexible arm model (a model of a relation between a speed and a velocity), model error compensation, nonlinear robust feedback, and linear stable feedback, thereby achieving precise control of the flexible arm posture.

The bottom lifting or lowering retracting apparatus includes a winch 31, a combination of vertical flexible arms 32, and a towing body 33. A net buoyancy of the vertical flexible arm 32 in water is preferably designed to be a positive value. After the winch 31 rotates forward, rigidity of the flexible arm can be increased rapidly after being detached from the winch. When the winch 31 rotates reversely, liquid inside the flexible arm is discharged to relieve pressure. The rigidity of the flexible arm is increased in the following method:

A part that is of the flexible arm and that is detached from the winch quickly pumps seawater into the flexible arm through a hydraulic pump. An internal flow channel of the flexible arm is squeezed and expanded by the liquid, and outside of the flexible arm is wrapped and constrained by a fiber rope, increasing material rigidity of the flexible arm. After the flexible arm is released from the winch, the flexible arm rises upward under the action of a positive buoyancy to form a vertical flexible arm, while a part of the flexible arm filled with liquid remains on the winch, so that rigidity of a rigid-flexible junction at a root of the vertical flexible arm is enough to support a carrier recovery action on an upper part the flexible arm.

When the flexible arm clamps and wraps the carrier, the winch reverses and rolls up the flexible arm, to drive the carrier down into the towing body, reducing the impact of water resistance on stability of carrier clamping. By far, recovery of the underwater moving carrier is completed.

Figure 6:
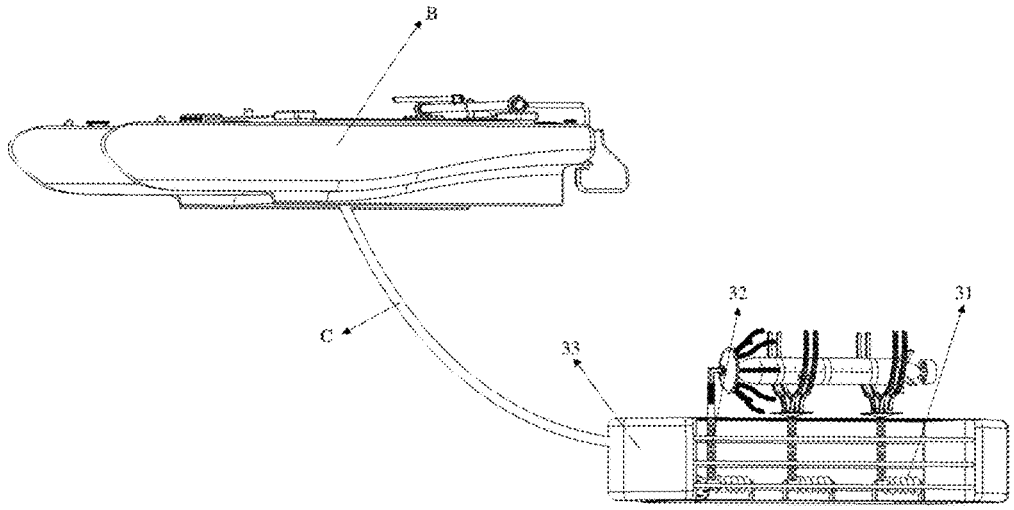
FIG. 6 is a schematic diagram of a recovery system for an underwater moving carrier.
Figure 7:
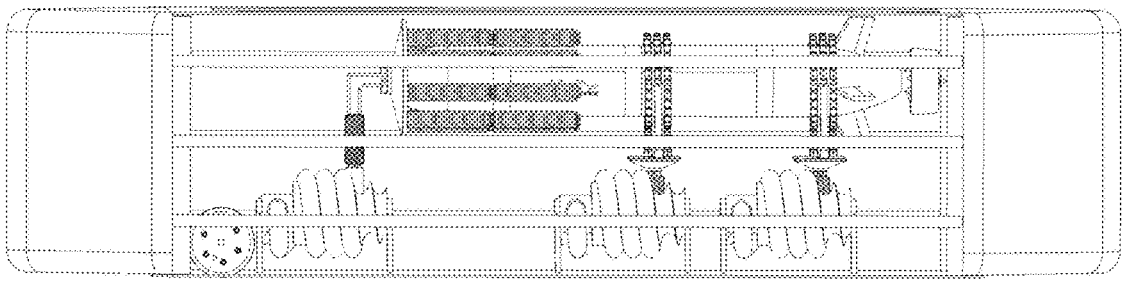
FIG. 7 is a schematic diagram of a state in which the underwater moving carrier is recovered and placed in a cabin.

As shown in FIG. 6, a recovery system for an underwater moving carrier is connected to a water surface mother ship B through a towing cable C. Several winches 31 are installed inside the towing body 33 to wind and release the vertical flexible arm 32. The vertical flexible arm 32 is connected to the flexible arm 1 and the flexible claw 2 to form a complete flexible recovery structure. Through the cooperation of the winch and the towing body, the carrier recovery can be completed, as follows:

When the underwater moving carrier approaches the flexible capturing system, an underwater sonar/visual hybrid sensing system sends an action trigger signal, calculates a desired posture of the flexible arms, and inputs the desired posture into a control system. The winch rotates forward and the flexible arm is detached from the winch. A part that is of the flexible arm and that is detached from the winch quickly pumps seawater into the flexible arm through a hydraulic pump. An internal flow chamber of the flexible arm is squeezed and expanded by the liquid, and outside of the flexible arm is wrapped and constrained by a fiber rope, increasing material stiffness of the flexible arm. After the flexible arm is released from the winch, the flexible arm rises upward under the action of a positive buoyancy to form a vertical flexible arm, while a part of the flexible arm filled with liquid remains on the winch, so that stiffness of a rigid-flexible junction at a root of the vertical flexible arm is enough to support a carrier recovery action on an upper part the flexible arm. When the flexible arm clamps and wraps the carrier, the winch reverses and rolls up the flexible arm, to drive the carrier down into the towing body, reducing the impact of water resistance on stability of carrier clamping. By far, the recovery of the underwater moving carrier is completed, and a recovery status is shown in FIG. 7.

Figure 8:
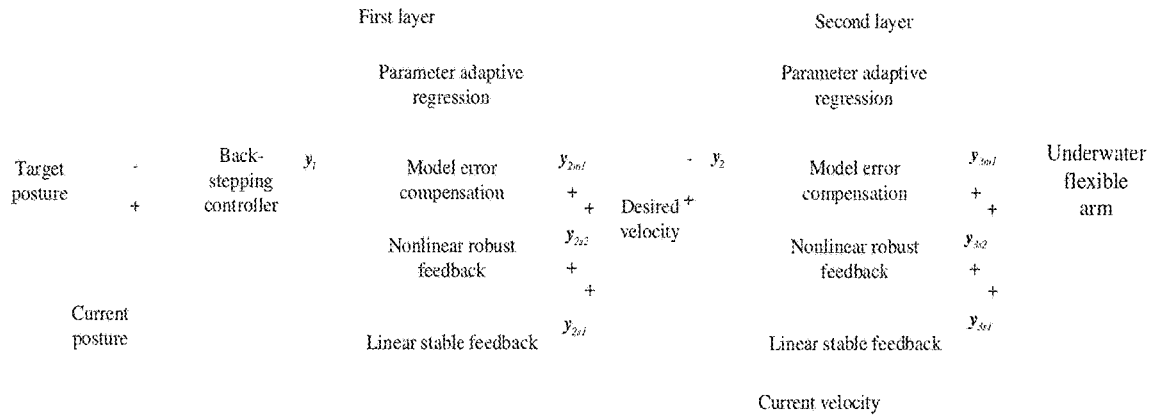
FIG. 8 is a control block diagram of the underwater flexible arm and the flexible claw.

As shown in FIG. 8, a two-layer adaptive robust control method is used for the flexible arm. The control system first uses a back-stepping controlling method to design a control rate that satisfies Lyapunov stability, and forms an intermediate target control amount, that is, a desired speed of the flexible arm, by using superposition of parameter adaptive regression a flexible arm model (a posture and velocity model), model error compensation, nonlinear robust feedback, and linear stable feedback. Furthermore, based on a current speed of the flexible arm, a control pressure of the underwater flexible arm is obtained through four calculation steps including parameter adaptive regression of a flexible arm model (a model of a relation between a speed and a velocity), model error compensation, nonlinear robust feedback, and linear stable feedback, thereby achieving precise control of the flexible arm posture.

The above embodiments describe in detail the technical solutions and beneficial effects of the present invention. It should be understood that the above are only specific embodiments of the present invention and are not intended to limit the present invention. Any modification, supplement, equivalent substitution, or the like made within a principle scope of the present invention shall be included in the protection scope of the present invention.

The invention claimed is:

1. A flexible dynamic capturing system for an underwater moving carrier, comprising a shell, a front-end flexible guide apparatus, at least one tail flexible hand clamping and fastening apparatus, a bottom retracting apparatus fastened in the shell, a sensing unit and a control unit, wherein:

the front-end flexible guide apparatus comprises several flexible arms and a first rigid base; the several flexible arms are fastened on the first rigid base in a circumferential array, two symmetrically distributed liquid-filled flow chambers are provided inside the flexible arm along an axial direction, and the flexible arms are capable of bending to an inner side and outer side of a circumference respectively when driven;

each tail flexible hand clamping and fastening apparatus comprises several flexible claws and a second rigid base; the several flexible claws are divided into two groups and fastened on the second rigid base; the flexible claw is a flexible tube provided with the liquid-filled flow channel inside, a tube wall on one side is corrugated, a tube wall on the other side is flat, and a flat tube wall is provided with a strain limiting layer; the flexible claw comprises a root section, a middle section, and an end section that are connected in sequence; and the root section is fastened on the second rigid base, when driven, root sections of the two sets of flexible claws bend toward the outside, and the middle sections and the end sections bend toward the inside, the two groups of flexible claws are capable of bending and winding relative to each other;

the bottom retracting apparatus comprises a winch fastened in the shell and a first vertical flexible arm and a second vertical flexible arm that are connected to the winch; the first rigid base is connected to the first vertical flexible arm through a bending rod, and the second rigid base is connected to the second vertical flexible arm through a bending rod; the front-end flexible guide apparatus and the tail flexible hand clamping and fastening apparatus are lifted or lowered by retracting the first vertical flexible arm and the second vertical flexible arm through the winch; and the first vertical flexible arm and the second vertical flexible arm are provided with liquid-filled flow chambers; net buoyancy forces in the water of the first vertical flexible arm and the second vertical flexible arm are positive values, when the winch rotates forward, rigidity of the vertical flexible arm is increased rapidly after being detached from the winch; and when the winch rotates reversely, liquid inside the vertical flexible arm is discharged to relieve pressure;

the sensing unit is configured to sense a position of the underwater moving carrier and send a signal that triggers the front-end flexible guide apparatus, the tail flexible hand clamping and fastening apparatus, and the bottom retracting apparatus to act; and the control unit controls, according to the signals, the flexible guide apparatus, the tail flexible hand clamping and fastening apparatus, and the bottom retracting apparatus to act, to capture the underwater moving carrier;

during operation, driving of the flexible arm and the flexible claw is divided into a liquid pre-filling stage and a rapid actuation stage; during the liquid pre-filling stage, a liquid volume in the liquid-filled flow chamber is kept the same as a volume of the liquid-filled flow channel without squeezing the liquid-filled flow chamber; and during the rapid actuation stage, an internal pressure of the flexible arm or the flexible claw is increased by adding fluid to the liquid-filled flow chamber, thereby causing the flexible arm or flexible claw to bend rapidly.

2. The flexible dynamic capturing system for an underwater moving carrier according to claim 1, wherein the flexible arm, the first vertical flexible arm, and the second vertical flexible arm are made of a soft material, outer surfaces thereof are covered with constraint layers that limit radial expansion of the flexible arms; and the liquid-filled flow chambers are provided inside the flexible arms.

3. The flexible dynamic capturing system for an underwater moving carrier according to claim 1, wherein a blocking net is installed on an inner side of the flexible arm of the front-end flexible guiding apparatus.

4. The flexible dynamic capturing system for an underwater moving carrier according to claim 1, wherein the control unit uses a two-layer adaptive robust control method; and a control process is as follows: when the underwater moving carrier approaches the flexible dynamic capturing system, the sensing unit sends an action trigger signal, calculates desired postures of the flexible arm and flexible claw, and inputs the desired postures to the control unit; and the control unit first uses a back-stepping controller to design a control rate that satisfies Lyapunov stability, and forms desired speeds of the flexible arm and the flexible claw by using superposition of parameter adaptive regression of a posture and speed in a flexible arm model, model error compensation, nonlinear robust feedback, and linear stable feedback, and then based on current speeds of the flexible arm and flexible claw, parameter adaptive regression of a relationship between a speed and pressure of the flexible arm model, model error compensation, nonlinear robust feedback, and linear stable feedback is implemented again, to obtain control pressures of the flexible arm and flexible claw, implementing precise control of postures of the flexible arm and the flexible claw.

* * * * *